United States Patent [19]

Koehl

[11] 4,154,062

[45] May 15, 1979

[54] MULTIPLE STAGE TELESCOPIC TRENCH LINING

[76] Inventor: Jean M. G. R. Koehl, 3, rue Varengue, 92340 Bourg-la-Reine, France

[21] Appl. No.: 746,339

[22] Filed: Dec. 1, 1976

[30] Foreign Application Priority Data

Dec. 1, 1975 [FR] France ..... 75 36757

[51] Int. Cl.[2] ..... E21D 19/00

[52] U.S. Cl. ..... 405/282

[58] Field of Search ..... 61/41 R, 41 A, 63, 105, 61/39.1, 34

[56] References Cited

U.S. PATENT DOCUMENTS

| | | | |
|---|---|---|---|
| 3,212,270 | 10/1965 | Benintend | 61/41 A |
| 3,782,125 | 1/1974 | Holl | 61/41 A |
| 3,788,086 | 1/1974 | West | 61/41 A |
| 3,910,053 | 10/1975 | Krings | 61/41 A |
| 3,937,026 | 2/1976 | Krings | 61/41 A |

FOREIGN PATENT DOCUMENTS

| | | | |
|---|---|---|---|
| 350933 | 1/1961 | Switzerland | 61/41 A |

*Primary Examiner*—Dennis L. Taylor
*Attorney, Agent, or Firm*—Hauke and Patalidis

[57] ABSTRACT

A trench lining assembly comprising at least two panels placed on each side of the trench and connected transversely together by at least one frame constituted by profiled pillars fixed at least temporarily on inner sides of the panels, said pillars cooperating with struts to form holding frames of the panels, and further providing means for longitudinally blocking the panels.

8 Claims, 10 Drawing Figures

MULTIPLE STAGE TELESCOPIC TRENCH LINING

There are already known devices for lining or timbering of trenches with panels which hold the edges of the trench as the trench is dug. However all these devices require the use of particular plates cooperating with poles and means maintaining the spacing of the panels, said means being very difficult to operate and realize. The materials required are costly, fragile and difficult to reuse because it becomes necessary either to replace some elements which have been distorted during use or to recondition said material between two utilisations which is costly.

The present invention copes with said disadvantages by creating a telescopic lining assembly for trenches with multiple stages, which permits the panels to be lowered as the digging of the trench progresses, protecting perfectly against any ground collapsing and are easy to use since they only require very simple holding elements to be positioned and can be easily placed and removed many times without requiring any repair, providing rapid reuse.

According to the invention, the multiple stage telescopic trench lining assembly comprises at least two panels on each side of a trench, said two panels being connected together by at least one frame comprising profiled pillars slidably engaged onto inner sides of the panels and cooperating with struts.

According to another feature of the invention, the profiled pillars fixed to the inner sides of first panels have the shape of a H for positioning at least one second set of panels parallel to the first set of panels.

Various other features of the invention are shown in the following detailed description.

Embodiments of the invention are shown by way of non-restrictive examples, in the accompanying drawings wherein.

Figure 1:
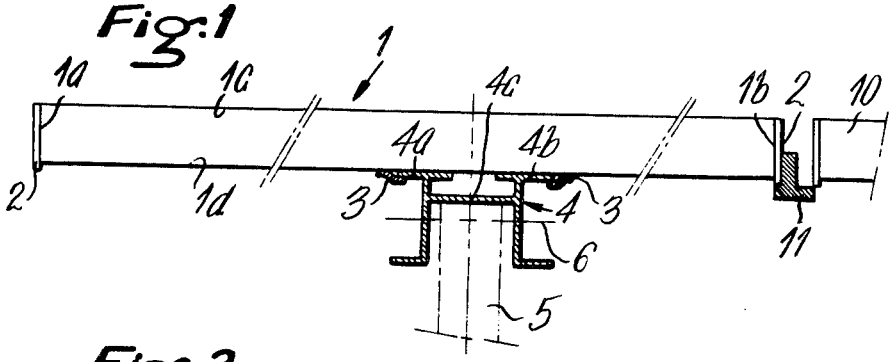
FIG. 1 is a plane view of the top of a panel used for lining of a trench.

In FIG. 1, there is shown a panel 1 of a parallelepiped shaped with outer edges 1*a*, 1*b* reinforced by a band 2. The side 1*c* of the panel 1 is applied against the edge of the trench while the side 1*d* is designed to receive, in the median area of the panel 1, slide forming irons 3 inside which can be slidingly positioned a pillar 4 having, in this embodiment, substantially the shape of a H whose wings 4*a*, 4*b* enable connection of this pillar 4 with the inner side of the panel 1 by means of the irons. The transverse arm 4*c* of the H is used as bearing point for struts 5 the position of which is determined by a pin 6 passing through holes bored in the arms of the H and in the bases of each strut 5.

As shown in FIG. 1, the frame comprised of two pillars 4 and at least two struts 5, is placed substantially in the middle of each panel 1 lining the right and left walls of a trench.

As the trench becomes deeper as digging progresses, the assembly formed by the panels 1 and frames made by the pillars 4 and struts 5 sinks until the upper edges of the panels 1 arrives at the level of the edge of the trench.

If the depth is sufficient, then it is advanced to a banking in front of the assembly formed by the panels and frames, and there is placed a second set of panels 10 (FIG. 1) which are connected to the preceding ones only by a T-shaped part 11 used for the centering and locking of the two lining units.

Of course, if the trench must be deeper than the height of the panels 1, it is possible to go on digging, then to make additional panels to go down inside the outer wings of the pillars 4, these panels being similar to the panels 1 and also comprising the same arrangements for positioning rigidification frames formed by the pillars 4 and struts 5.

Figure 2:
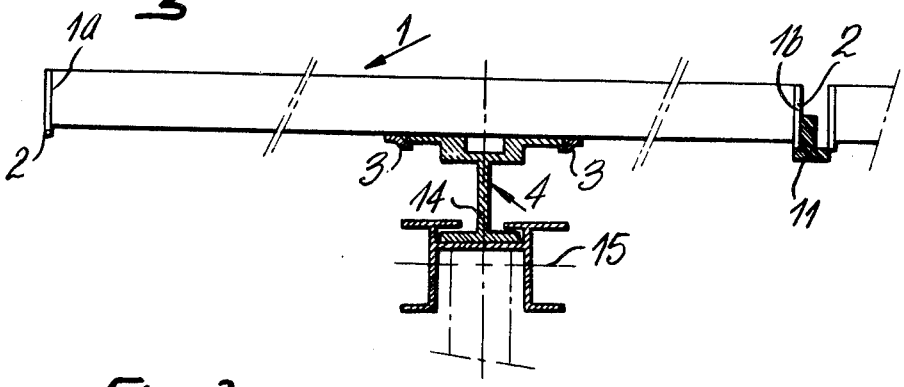
FIG. 2 is a top plane view showing a panel lining the upper portion of a trench before placing additional panels lining the lower portions of a trench of a great depth.
Figure 9:
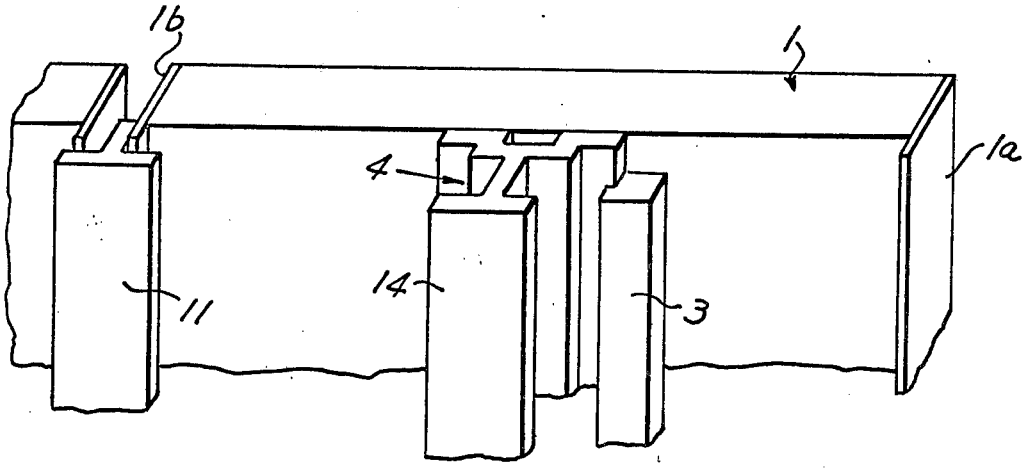
FIG. 9 is a partial perspective view of FIG. 2.

In FIG. 2, and as shown in FIG. 9, the device is similar to that of FIG. 1 but the pillar 4 is divided into two parts 14, 15, one in the shape of a I and the other in the shape of a H, thus making possible lowering three vertical panels placed in three parallel planes, said panels being similar to the panel 1 and held in place by frames comprised of the pillars 4 and struts 5 of FIG. 1.

Figure 3:
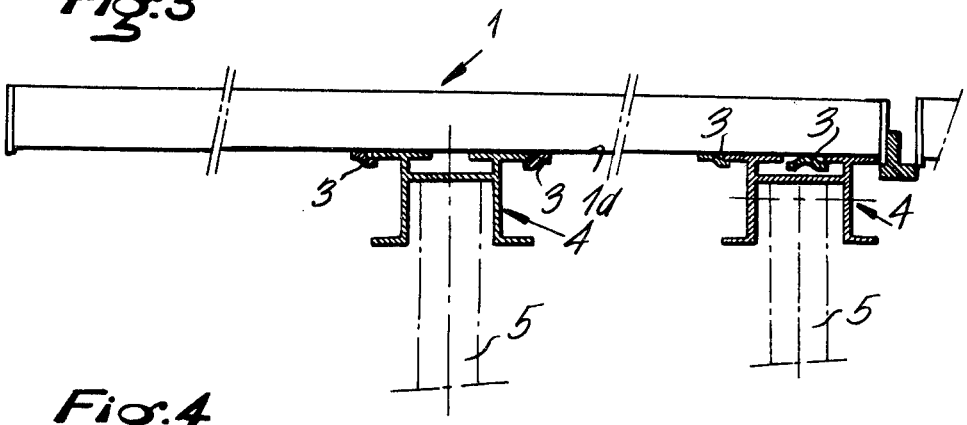
FIGS. 3 and 4 show variants of arrangement of the frames holding the panels.
Figure 4:
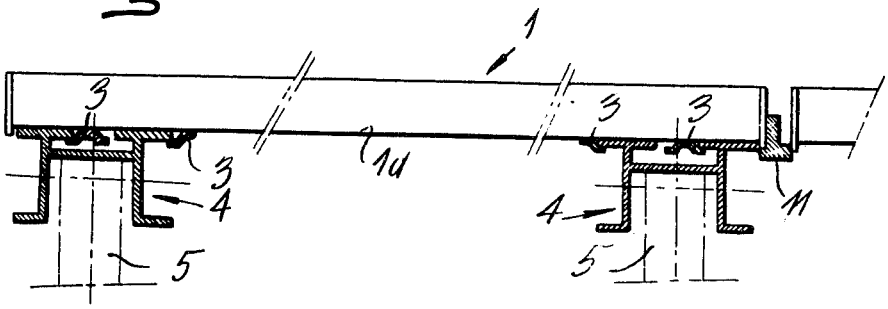

Heretofore in the description the frames 4, 5 have been considered as located in the middle of the panels but in some embodiments, it is necessary, due to the nature of the ground in which the trenches are dug, to have a plurality of frames 4, 5 for each panel 1. Then, as shown in FIGS. 3, 4 and on the inner side 1*d* of the panels 1, irons 3 are provided either in the median area and at the ends of the panels (FIG. 3), or only at the ends of the panels (FIG. 4). The remainder of the assembly of these trench linings is similar to that shown in FIGS. 1 and 2, and heretofore described because it is possible, in any case, to replace the pillars 4 in the shape of a H by pillars in the shape of I and in H (see FIG. 2).

Figure 5:
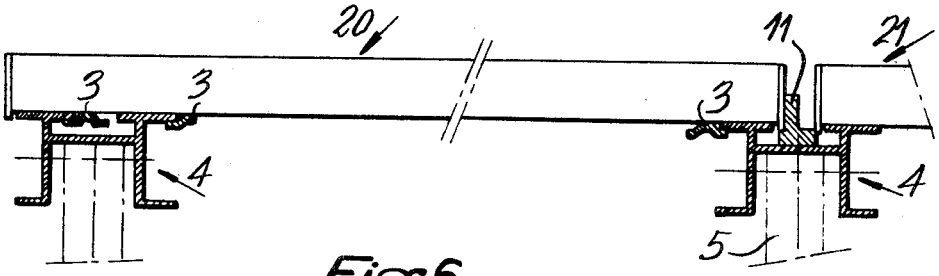
FIGS. 5, 6, 7 and 8 are plane views showing the use of the multilple stage telescopic trench lining with holding frames for the panels.

In FIG. 5 there is shown a panel 20, similar to the panel 1, comprising irons 3 at both its ends, thus enabling positioning two pillars 4 slidingly fixed to the panel 20, with the pillar 4 placed on the right side of the panel 20 cooperating both with the panel 20 and with the panel 21 which is adjacent thereto. Member 11 in the shape of a T is used at the same time as abutment for the pillars 4 placed astride between the two panels which causes the frame 4, 5 in question to be perfectly born and supported and, then to correctly hold the panels. The panels are then longitudinally blocked.

Figure 6:
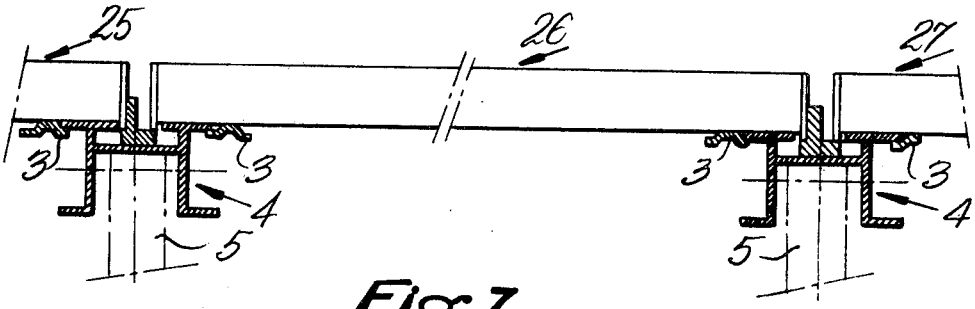

In FIG. 6, the panels 25, 26, 27 which are aligned, are held in the same way as described for the right portion of the panel 20 in FIG. 5. It is thus seen that it is possible to very quickly position trench linings which go down or descend as the depth of the trench increases and which can be removed very quickly in slidingly lifting them upon banking of the trench. Since no abnormal strain has to be exerted on the panels or on the frames, since the frames are loosened in advance, the parts constituting the entire lining can be quickly removed for reuse, either on the same work site or on another work site.

Figure 7:
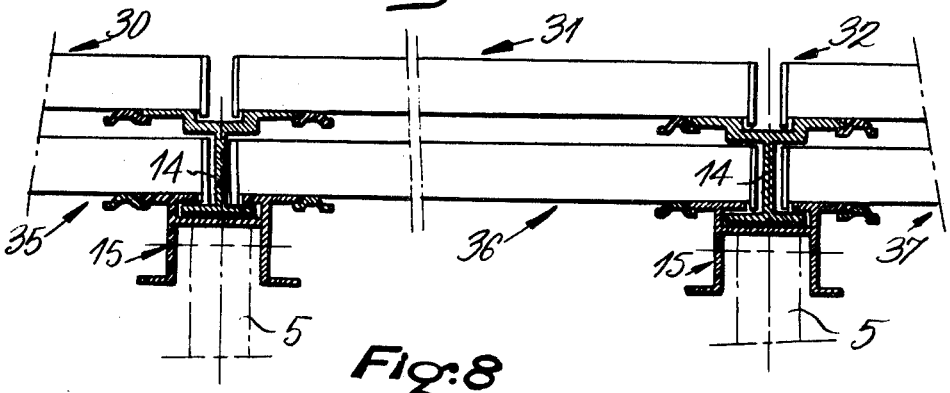
Figure 8:
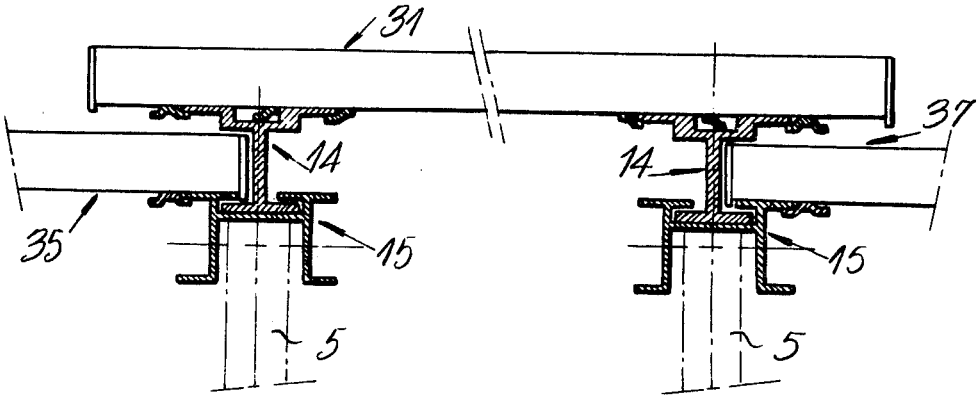
Figure 10:
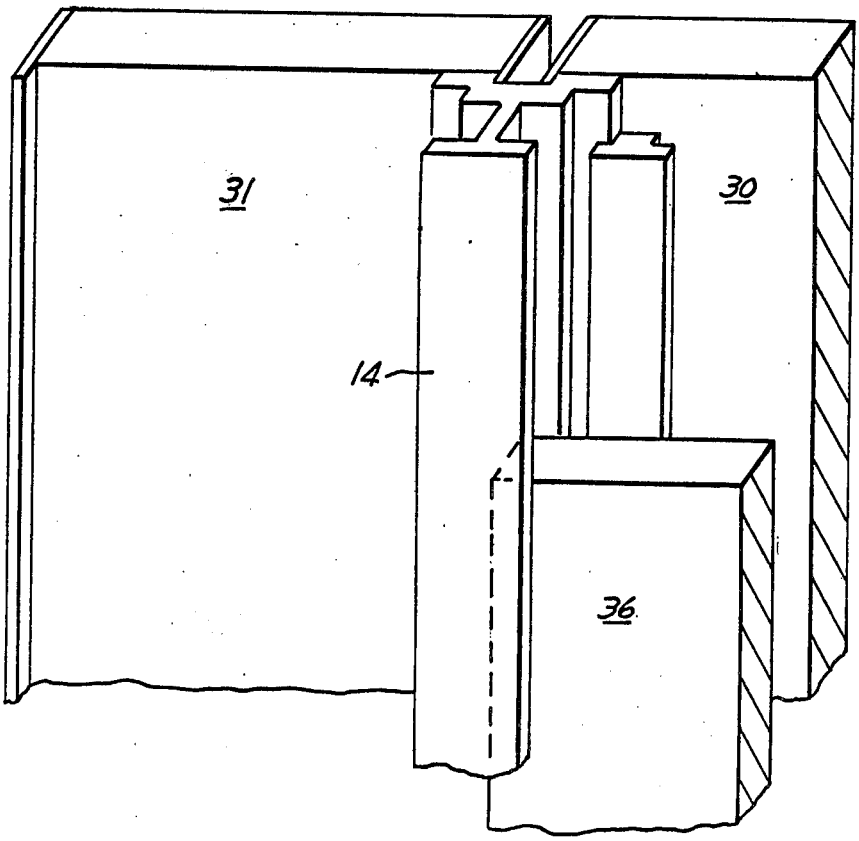
FIG. 10 is a partial perspective view of FIG. 7.

FIGS. 7, 8 and 10 show positioning of various panels as the digging of a trench goes on, in order to hold (by means of panels 30, 31, 32 then 35, 36, 37) the walls of the trench by only using pillars in I and in H shapes cooperating with a predetermined number of struts 5, a number which is generally predetermined by the nature of the ground in which the banking is made.

The assembly as above described obtains a real trench lining assembly which may be used in practically all cases where it is possible to use panels of great surface area, said panels being either unitary or not.

This device which prevents in all cases any contact between the ground and the frames holding the panels, therefore prevents in a sure way damage of these frames by the ground and does not necessitate in any case driving poles or the like in the ground, which would be disadvantageous, long, and laborious and which often damages to the material.

I claim:

1. A multiple stage telescopic trench lining assembly comprising a set of panels comprising at least a pair of transversely aligned panels each disposed substantially vertically as a lining at each side wall of a trench in the ground, each of said panels having an outer face engaged with the ground at said side wall and an inner face, at least one profiled pillar driven substantially vertically in the ground slidably engaged with the inner face of each of said panels, means on said inner face co-operating with said pillar for defining a guiding sliding engagement therewith, and struts disposed transversely to the trench and having ends each abutting opposite pillars, wherein the profiled pillars slidably engaged with the inner face of said panels of said first mentioned set are each at least H-shaped in section for positioning and holding at least one second set of panels placed in a plane parallel to that formed by each panel of the first set of panels, each of the panels in said second set being slidably engaged at their edges between the wings formed by said H-shaped section.

2. A telescopic trench lining assembly as set forth in claim 1 wherein each set of panels comprises consecutive spaced apart panels at each said side wall of the trench and further comprising means for blocking the space between the panels.

3. A telescopic trench lining assembly as set forth in claim 1 wherein the profiled pillars slidably engaged with the inner face of said panels of said first mentioned set are each I- and H-shaped in section for positioning and holding at least a second and third sets of panels placed in parallel planes parallel to that formed by the first set of panels, the panels in said second and third sets being slidably engaged at their edges between the wings formed by said I- and H-shaped section.

4. A telescopic trench lining assembly as set forth in claim 1 wherein the end edges of the panels are provided with reinforcement bands.

5. A telescopic trench lining assembly as set forth in claim 1 wherein the means on the inner face of the panels defining a slidable engagement of the profiled pillars with the inner face of the panels comprises a pair of parallel shaped irons affixed to said inner face of the panels.

6. A telescopic trench lining assembly as set forth in claim 5 wherein the shaped irons are placed intermediate the ends of the panels.

7. A telescopic trench lining assembly as set forth in claim 1, wherein the struts are adjustable in length.

8. A telescopic trench lining assembly as set forth in claim 5, wherein the shaped irons are fixed to the panels near the ends thereof.

* * * * *